US011786427B2

(12) United States Patent
Herman et al.

(10) Patent No.: US 11,786,427 B2
(45) **Date of Patent: *Oct. 17, 2023**

(54) SIDERAIL POWER COMMUNICATION INTERFACE

(71) Applicant: Hill-Rom Services, Inc., Batesville, IN (US)

(72) Inventors: Fred Herman, Cincinnati, OH (US); Thomas F. Heil, Batesville, IN (US); Charles A. Howell, Knoxville, TN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/940,075

(22) Filed: Sep. 8, 2022

(65) Prior Publication Data

US 2023/0000701 A1 Jan. 5, 2023

Related U.S. Application Data

(63) Continuation of application No. 17/219,032, filed on Mar. 31, 2021, now Pat. No. 11,464,693, which is a continuation of application No. 16/185,074, filed on Nov. 9, 2018, now Pat. No. 10,987,263, which is a continuation of application No. 15/175,642, filed on Jun. 7, 2016, now Pat. No. 10,123,925, which is a (Continued)

(51) Int. Cl.
*A61G 7/05* (2006.01)
*A47C 21/08* (2006.01)

(52) U.S. Cl.
CPC ..... *A61G 7/0507* (2013.01); *A61G 7/0509* (2016.11); *A61G 7/0514* (2016.11); *A61G 7/0524* (2016.11); *A47C 21/08* (2013.01)

(58) Field of Classification Search
CPC ..... A61G 7/0507; A61G 7/0524; A47C 21/08
USPC ..... 5/424–430, 100
See application file for complete search history.

(56) References Cited

U.S. PATENT DOCUMENTS 1,275,208 A 8/1918 Bockshe
3,878,570 A 4/1975 Donnelly
(Continued)

FOREIGN PATENT DOCUMENTS

EP 1275208 B1 10/2004
EP 2374440 A2 10/2011
(Continued)

OTHER PUBLICATIONS

European Search Report for EP Application 11161746; Place of Search—The Hague; Date of Completion of the Search—Oct. 19, 2012.

*Primary Examiner* — Robert G Santos
(74) *Attorney, Agent, or Firm* — Barnes & Thornburg LLP

(57) ABSTRACT

A siderail assembly for a person support apparatus comprises a siderail body, a grip portion, and a power communication device. The siderail body includes a front surface, a back surface, and a side surface extending between the front surface and the back surface. The side surface defines a perimeter of the siderail body. The grip portion includes a siderail opening through a portion of the siderail body. The grip opening has an upper grip opening portion that cooperates with the side surface to define a grip. The power communication device is configured to communicate power to a device.

20 Claims, 10 Drawing Sheets

Related U.S. Application Data continuation of application No. 12/757,233, filed on Apr. 9, 2010, now Pat. No. 9,375,374.

(56) References Cited

U.S. PATENT DOCUMENTS

| | | | |
|---|---|---|---|
| 6,185,767 | B1 | 2/2001 | Brooke et al. |
| 6,611,979 | B2 | 9/2003 | Welling et al. |
| 6,658,680 | B2 | 12/2003 | Osborne et al. |
| 6,691,346 | B2 | 2/2004 | Osborne et al. |
| 6,781,517 | B2 | 8/2004 | Moster et al. |
| 6,880,189 | B2 | 4/2005 | Welling et al. |
| 6,957,461 | B2 | 10/2005 | Osborne et al. |
| 6,978,500 | B2 | 12/2005 | Osborne et al. |
| 7,171,708 | B2 | 2/2007 | Osborne et al. |
| 7,200,882 | B2 | 4/2007 | Heimbrock |
| 7,430,771 | B2 | 10/2008 | Heimbrock |
| 7,454,805 | B2 | 11/2008 | Osborne et al. |
| 7,887,113 | B2 | 2/2011 | Lambarth et al. |
| 8,100,061 | B2 | 1/2012 | Hookway et al. |
| RE43,193 | E | 2/2012 | Osborne et al. |
| 8,125,318 | B2 | 2/2012 | Heimbrock et al. |
| 8,143,846 | B2 | 3/2012 | Herman et al. |
| 8,151,387 | B2 | 4/2012 | Osborne et al. |
| 8,347,433 | B1 | 1/2013 | Shih |
| 8,499,384 | B2 | 8/2013 | Zerhusen |
| 8,618,918 | B2 | 12/2013 | Tallent et al. |
| 8,677,528 | B2 | 3/2014 | Hookway et al. |
| 9,375,374 | B2 | 6/2016 | Herman et al. |
| 9,427,544 | B2 | 8/2016 | Frater et al. |
| 9,642,967 | B2 | 5/2017 | Ribble et al. |
| 9,700,247 | B2 | 7/2017 | Dixon et al. |
| 9,827,157 | B2 | 11/2017 | Newkirk et al. |
| 10,016,325 | B2 | 7/2018 | Ribble et al. |
| 10,123,925 | B2 | 11/2018 | Herman et al. |
| 10,363,183 | B2 | 7/2019 | Ribble et al. |
| 10,842,695 | B2 | 11/2020 | Newkirk et al. |
| 10,940,068 | B2 | 3/2021 | Patmore et al. |
| 10,980,689 | B2 | 4/2021 | Bhimavarapu et al. |
| 10,987,263 | B2 | 4/2021 | Herman et al. |
| 11,273,088 | B2 | 3/2022 | Newkirk et al. |
| 11,464,693 | B2 | 10/2022 | Herman et al. |
| 2001/0032362 | A1 | 10/2001 | Welling et al. |
| 2002/0002742 | A1 | 1/2002 | Osborne et al. |
| 2002/0066142 | A1 | 6/2002 | Osborne et al. |
| 2003/0094855 | A1 | 5/2003 | Lohr et al. |
| 2004/0034936 | A1 | 2/2004 | Welling et al. |
| 2004/0128765 | A1 | 7/2004 | Osborne et al. |
| 2004/0177445 | A1 | 9/2004 | Osborne et al. |
| 2005/0166324 | A1 | 8/2005 | Dixon et al. |
| 2005/0188462 | A1 | 9/2005 | Heimbrock |
| 2006/0053554 | A1 | 3/2006 | Acton |
| 2006/0056616 | A1 | 3/2006 | Heimbrock |
| 2006/0058587 | A1 | 3/2006 | Heimbrock et al. |
| 2006/0075560 | A1 | 4/2006 | Osborne et al. |
| 2006/0096029 | A1 | 5/2006 | Osborne et al. |
| 2006/0113955 | A1 | 6/2006 | Nunally |
| 2007/0163043 | A1 | 7/2007 | Lemire et al. |
| 2007/0180616 | A1 | 8/2007 | Newkirk et al. |
| 2007/0192958 | A1 | 8/2007 | Heimbrock |
| 2008/0172789 | A1 | 7/2008 | Elliot et al. |
| 2008/0235872 | A1 | 10/2008 | Newkirk et al. |
| 2009/0015027 | A1 | 1/2009 | Lambarth et al. |
| 2009/0112630 | A1 | 4/2009 | Collins, Jr. et al. |
| 2009/0139028 | A1 | 6/2009 | Morin et al. |
| 2009/0307843 | A1 | 12/2009 | Hookway et al. |
| 2010/0229304 | A1 | 9/2010 | Heimbrock et al. |
| 2011/0030141 | A1 | 2/2011 | Soderberg et al. |
| 2011/0162145 | A1 | 7/2011 | Osborne et al. |
| 2011/0247135 | A1 | 10/2011 | Herman et al. |
| 2011/0247137 | A1 | 10/2011 | Herman et al. |
| 2011/0247139 | A1 | 10/2011 | Tallent et al. |
| 2011/0248672 | A1 | 10/2011 | Herman et al. |
| 2012/0090091 | A1 | 4/2012 | Hookway et al. |
| 2012/0233774 | A1 | 9/2012 | Zerhusen |
| 2013/0253291 | A1 | 9/2013 | Dixon et al. |
| 2014/0338124 | A1 | 11/2014 | Newkirk et al. |
| 2015/0342361 | A1 | 12/2015 | Shih |
| 2016/0136356 | A1 | 5/2016 | Ribble et al. |
| 2017/0224561 | A1 | 8/2017 | Ribble et al. |
| 2017/0319412 | A1 | 11/2017 | Herman et al. |
| 2018/0049933 | A1 | 2/2018 | Newkirk et al. |
| 2018/0296413 | A1 | 10/2018 | Ribble et al. |
| 2019/0015276 | A1 | 1/2019 | Bhimavarapu et al. |
| 2019/0076311 | A1 | 3/2019 | Herman et al. |
| 2019/0192367 | A1 | 6/2019 | Patmore et al. |
| 2021/0022936 | A1 | 1/2021 | Newkirk et al. |
| 2021/0154068 | A1 | 5/2021 | Patmore et al. |
| 2021/0212872 | A1 | 7/2021 | Herman et al. |
| 2021/0330526 | A1 | 10/2021 | Kennedy et al. |
| 2023/0000701 | A1* | 1/2023 | Herman ..... A61G 7/0509 |

FOREIGN PATENT DOCUMENTS

| | | | |
|---|---|---|---|
| EP | 2374441 | A2 | 10/2011 |
| EP | 2374442 | A2 | 10/2011 |
| EP | 2641577 | A2 | 9/2013 |
| WO | 1994027544 | A2 | 12/1994 |

* cited by examiner

SIDERAIL POWER COMMUNICATION INTERFACE

This application is a continuation of U.S. application Ser. No. 17/219,032, filed Mar. 31, 2021, now U.S. Pat No. 11,464,693, which is a continuation of U.S. application Ser. No. 16/185,074, filed Nov. 9, 2018, now U.S. Pat. No. 10,987,263, which is a continuation of U.S. application Ser. No. 15/175,642, filed Jun. 7, 2016, now U.S. Pat. No. 10,123,925, which is a continuation of U.S. application Ser. No. 12/757,233 filed Apr. 9, 2010, now U.S. Pat. No. 9,375,374, each of which is hereby expressly incorporated by reference herein.

BACKGROUND

This disclosure relates generally to siderails. More particularly, but not exclusively, one illustrative embodiment relates to a siderail for a person-support apparatus including a power communication device configured to communicate power to a device in communication therewith.

People staying in hospitals can often bring electronic devices, such as, a music and/or video player, a mobile phone, a video game device, etc. The devices can need to be recharged from time to time for their effective use. While various person-support apparatuses have been developed, there is still room for development. Thus a need persists for further contributions in this area of technology.

SUMMARY

The present disclosure includes one or more of the features recited in the appended claims and/or the following features which, alone or in any combination, may comprise patentable subject matter.

In one illustrative embodiment, a person-support apparatus can include a siderail with a power communication device configured to communicate power to a device in communication therewith. In another illustrative embodiment, a siderail assembly includes a power communication device configured to communicate power wirelessly to a device in communication therewith. In yet another illustrative embodiment, a siderail assembly includes a power communication device with a connector positioned along at least one of a siderail grip and a lower side surface of a siderail grip portion.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
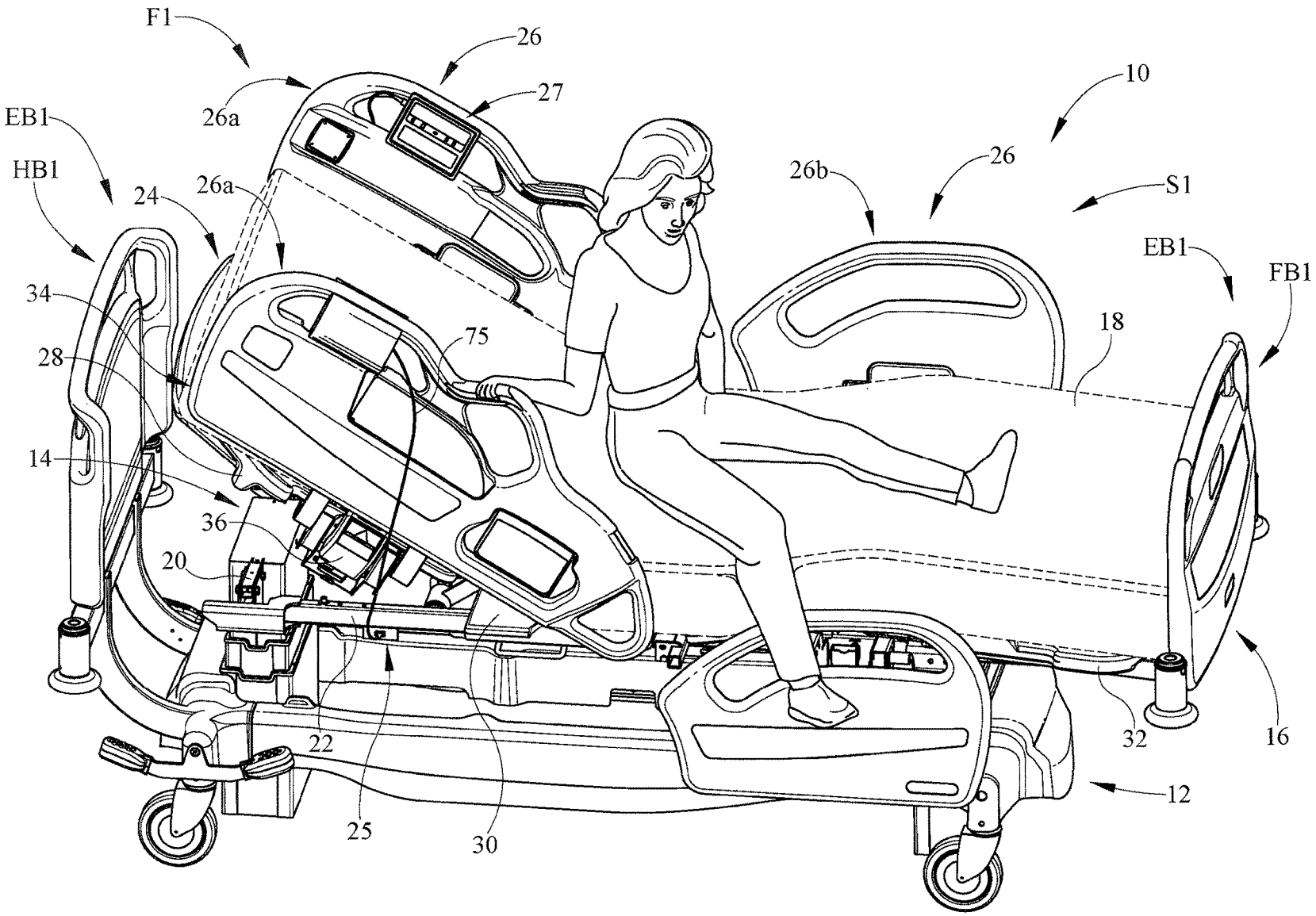
FIG. 1 is a perspective side view of a person-support apparatus showing a siderail according to one illustrative embodiment of the disclosure.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

In one illustrative embodiment, a person-support apparatus can include a siderail with a power communication interface configured to communicate power to a device in communication therewith. In another illustrative embodiment, a siderail assembly includes a power communication interface configured to communicate power wirelessly to a device in communication therewith. In yet another illustrative embodiment, a siderail assembly includes a power communication interface with a connector positioned along at least one of a siderail grip and a lower side surface of a siderail grip portion.

A person-support apparatus 10 according to one illustrative embodiment of the current disclosure is shown in FIG. 1. The person-support apparatus 10 can have a first section F1 or head support section F1, where the head of a person can be positioned and a second section S1 or a foot support section S1, where the feet of the person can be positioned. In one illustrative embodiment, the person-support apparatus 10 can be a hospital bed. It should be appreciated that the person-support apparatus 10 can also be a hospital stretcher or an operating table.

The person-support apparatus 10 can include a lower frame 12 or base 12, a plurality of supports 14 coupled with the lower frame 12, an upper frame 16 supported on the supports 14 above the lower frame 12, and a control system 17 configured to control at least one function of the person-support apparatus 10. It should be appreciated that the supports 14 can be lift mechanisms 14 that can move the upper frame 16 with respect to the lower frame 12. It should also be appreciated that in one illustrative embodiment the person-support apparatus 10 can support a person-support surface 18 thereon.

The upper frame 16 can include an upper frame base 20, an intermediate frame 22, a deck 24, a data and/or power interface 25, siderails 26, and an accessory module 27 as shown in FIG. 1. It should be appreciated that the upper frame 16 can also include endboard EB1, such as, for example, a headboard HB1 and a footboard FB1, coupled to the first section F1 and the second section S1 of the person-support apparatus 10. The upper frame base 20 can be coupled to the supports 14 and can support the intermediate frame 22 and the deck 24 thereon as shown in FIG. 1. The deck 24 can be movably coupled to the intermediate frame 22 and can include a head portion 28, a seat portion 30, and a foot portion 32. The head portion 28, the seat portion 30, and the foot portion 32 can be movably coupled with each other and/or the intermediate frame 22.

The data and/or power interface 25 shown in FIG. 1 can be configured to transmit and/or receive a data signal and/or a power signal to/from a control device (not shown) and/or other device or system coupled thereto, such as, the accessory module 27. In one illustrative embodiment, the data and/or power interface 25 can be an RS-232 serial port and can be configured to output about 8 V DC. It should be appreciated that the data and/or power interface 25 can be a USB interface port, parallel port, or other interface configured to transmit and/or receive the data signal and/or the power signal. It should also be appreciated that the data and/or power interface 25 can have separate data and power connectors.

The siderails 26 can include a siderail body 34 with a top portion ST1 and a bottom portion SB1, a siderail linkage 36, and a siderail communication system 37 as shown in FIGS. 1-2 and 7-9. It should be appreciated that the endboard EB1 can include a communication system (not shown) like the siderail communication system 37. The siderail linkage 36 can be coupled to the bottom portion SB1 of the siderail body 34 and can couple the siderails 26 to the deck 24 and/or the intermediate frame 22. In one illustrative embodiment, the siderails 26 can be coupled to the head portion 28 of the deck 24 and/or intermediate frame 22 (i.e., a first siderail 26*a* or a head siderail 26*a*) and/or coupled to the foot portion 32 of the deck 24 and/or the intermediate frame 22 (i.e., a second siderail 26*b* or a foot siderail 26*b*) as shown in FIG. 1.

The siderail linkage 36 can be configured to facilitate movement of the siderails 26 between a deployed/operation position and a storage position as shown in FIG. 1. In the deployed/operation position, as shown in FIG. 1, at least a portion of the siderails 26 can be present above the upper frame 16. In the storage position, the siderails 26 can be moved to a lower position where at least a portion of the siderail 26 is below the deployed/operation position. It should be appreciated that the siderail linkage 36 can include a locking mechanism (not shown) that can maintain the siderails 26 in one of the operating and/or storage position when locked and can facilitate movement of the siderails 26 between the operating and storage position when unlocked.

Figure 7:
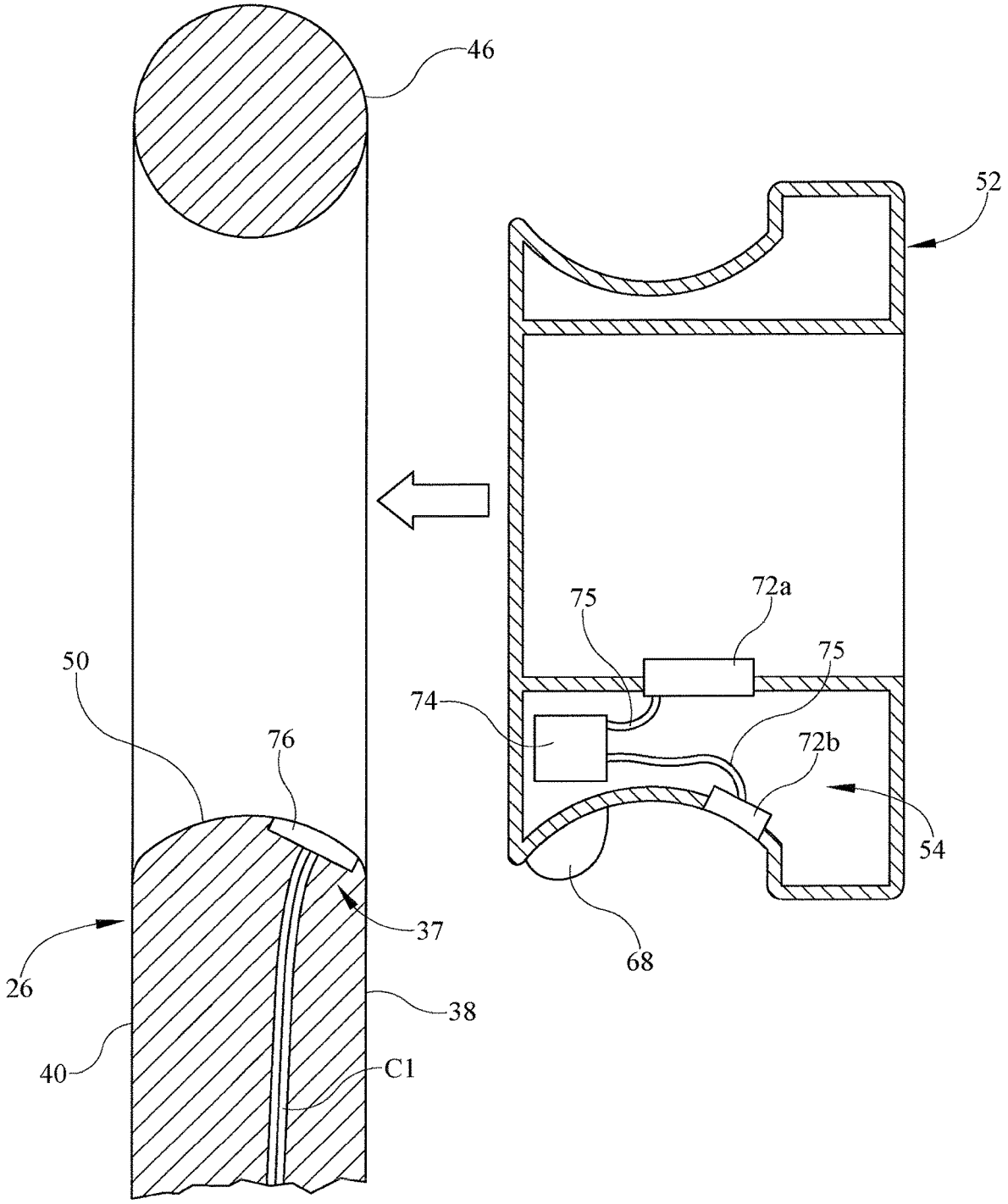
FIG. 7 is a side cross-sectional view of the siderail according to one illustrative embodiment showing a first contact coupled to an engagement surface of the accessory module and a second contact coupled to the siderail and configured to engage the first contact.
Figure 8:
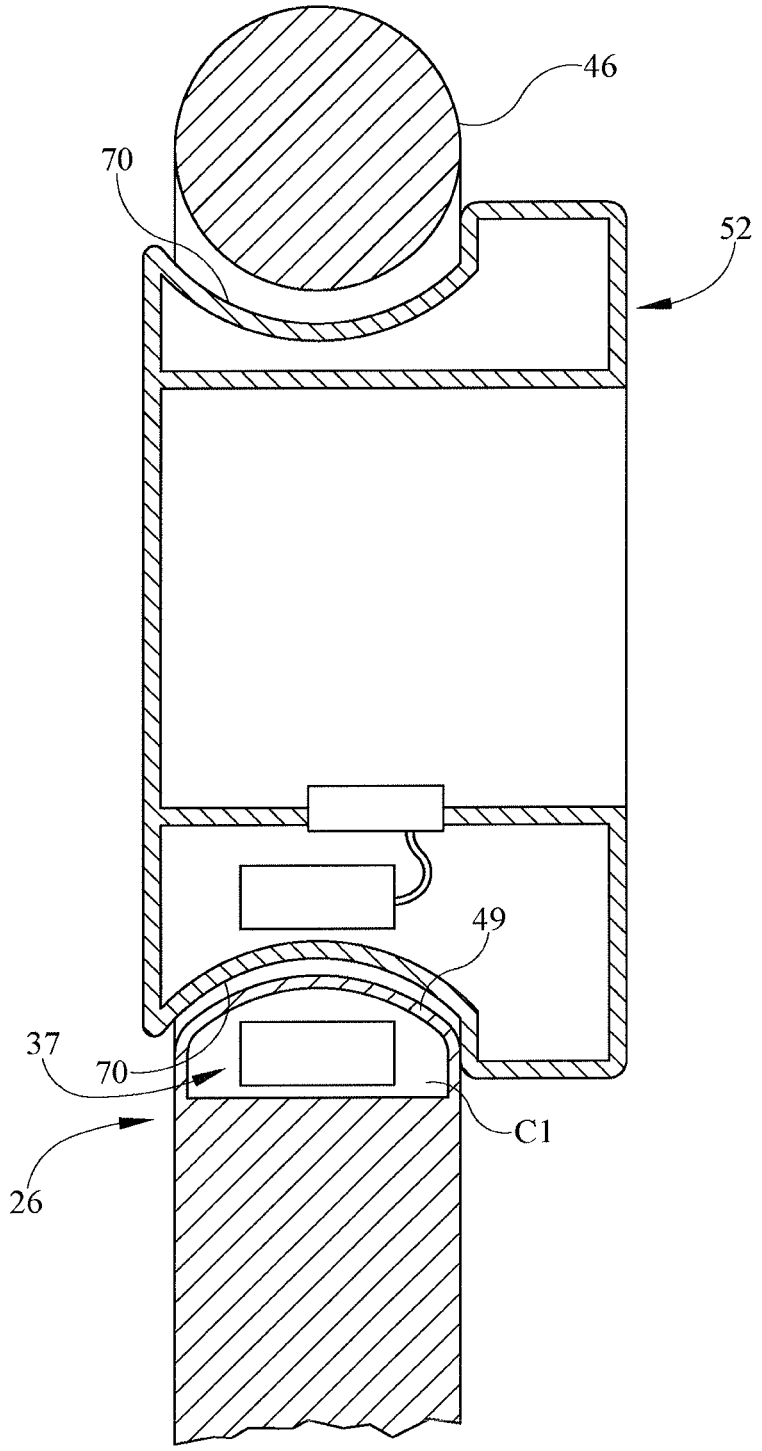
FIG. 8 is a side cross-sectional view of the siderail according to another illustrative embodiment showing an inductive arrangement with a first coil positioned in the siderail and a second coil positioned in the accessory module.
Figure 9:
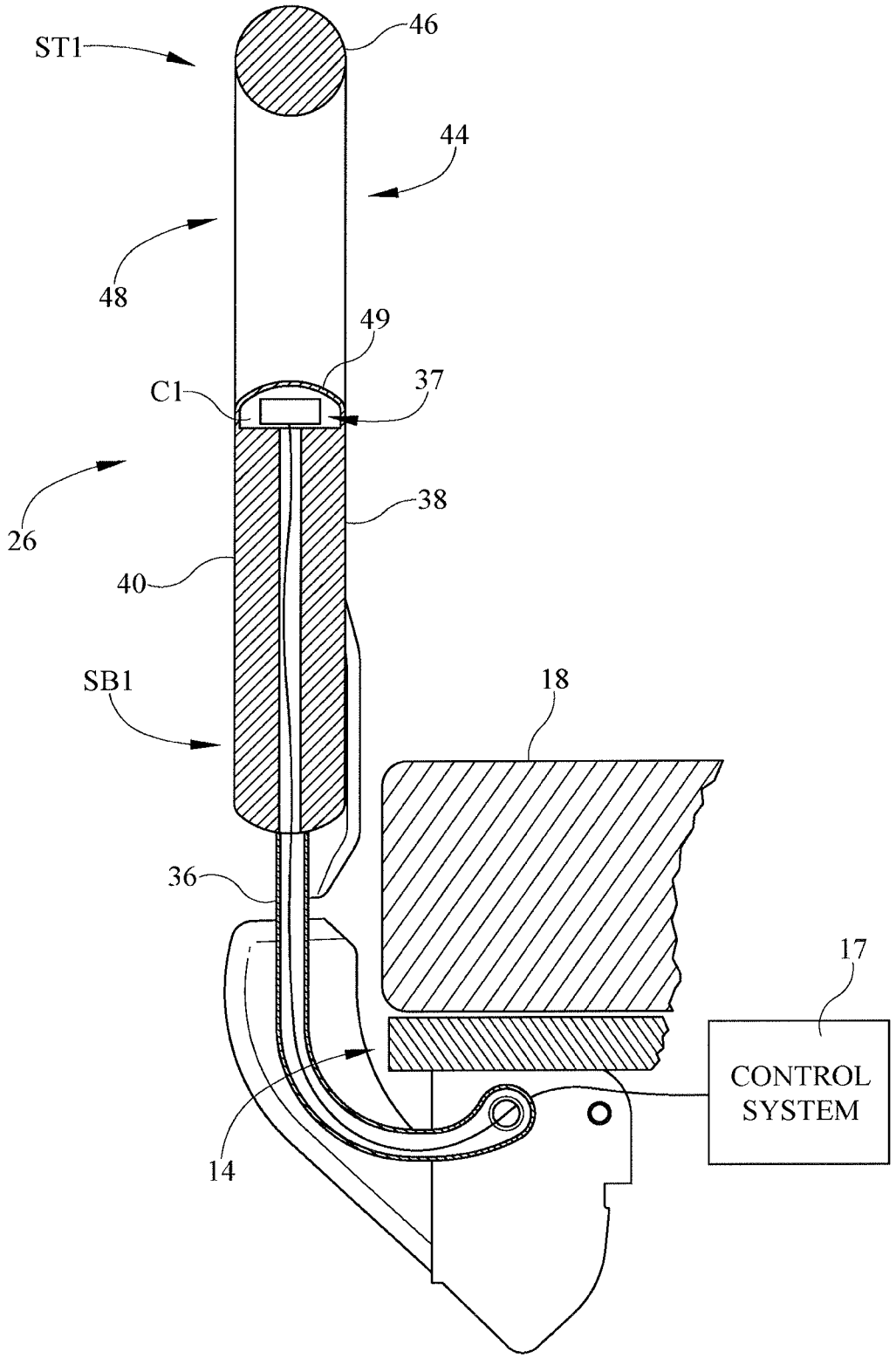
FIG. 9 is a cross-sectional side view of the siderail of FIG. 1 coupled to the frame by the linkage and the power communication interface connected to the person-support apparatus control system by a cable.

The siderail body 34 can include a first surface 38, a second surface 40, a side surface 42 extending between the first surface 38 and the second surface 40 and a grip portion 44 as shown in FIGS. 2 and 7-9. It should be appreciated that the siderail 26 can include a person interface (not shown) that can be in communication with the control system 17 to selectably control various functionalities of the person-support apparatus 10. It should also be appreciated that the first surface 38, the second surface 40, and the side surface 42 can cooperate to define a chamber C1 in which the communication system 37 can be positioned as shown in FIGS. 8 and 9. At least a portion of the first surface 38 and the second surface 40 can be substantially parallel to one another. The first surface 38 can be oriented such that the first surface 38 faces toward the upper frame 16 and the second surface 40 can be oriented such that the second surface 40 faces away from the upper frame 16.

Figure 2:
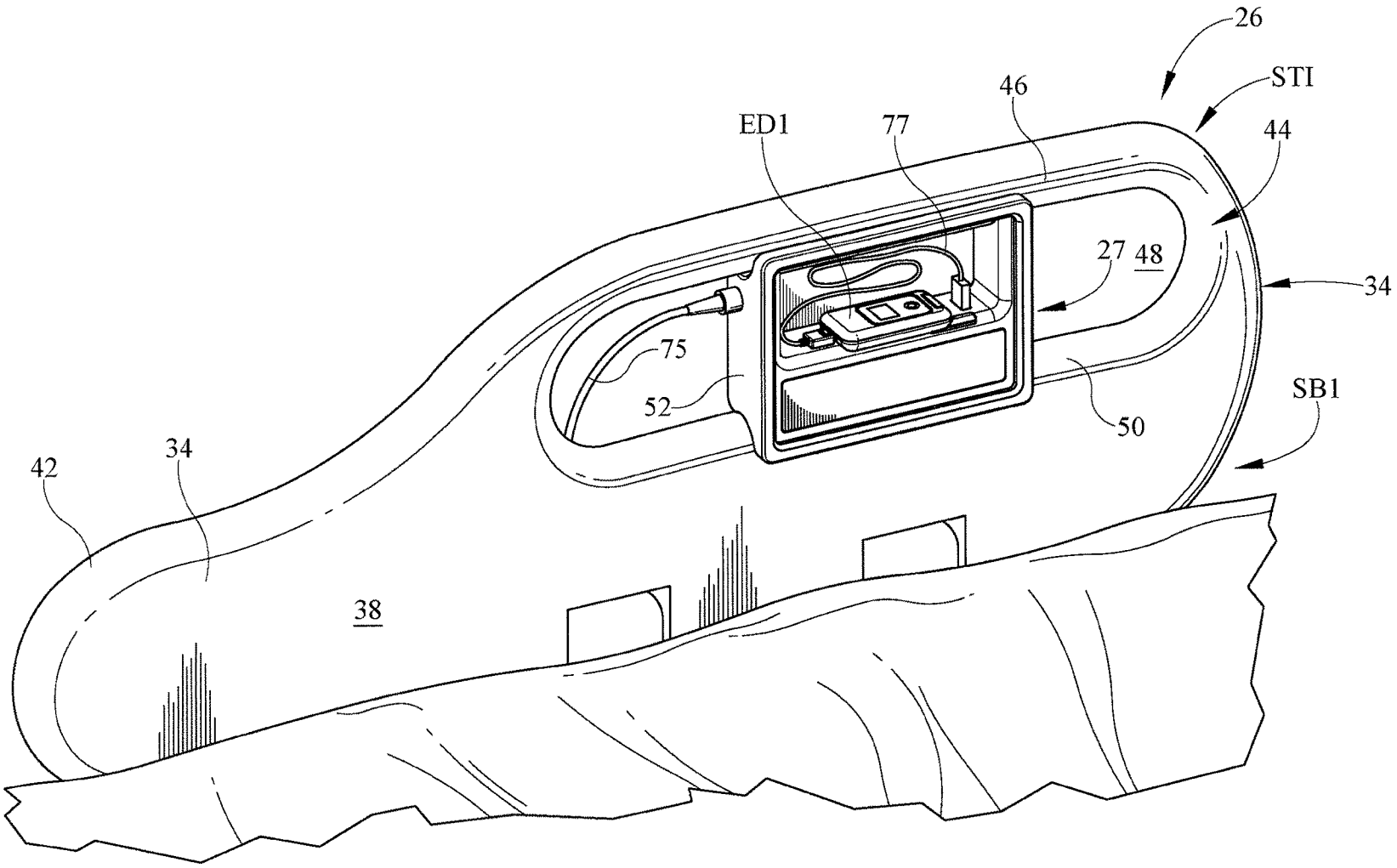
FIG. 2 is a perspective side view of the siderail of FIG. 1 with an accessory module coupled thereto according to one illustrative embodiment of the disclosure.

The grip portion 44 shown in FIG. 2 can be configured to be gripped by a person to assist the person with ingress/egress to/from the person support apparatus 10. In one illustrative embodiment, the grip portion 44 can be located along the top portion ST1 and can include a grip 46 and a grip opening 48. The grip opening 48 can pass through the siderail body 34 and be configured to allow a person to wrap at least a portion of their fingers/hand around the grip 46. In one illustrative embodiment, an upper portion of the grip opening 48 can define the bottom of the grip 46 and a lower portion of the grip opening 48 opposite the upper portion of the grip opening 48 can define a portion of the upper side surface 49.

The siderail communication system 37 can be configured to transmit and/or receive a data signal and/or a power signal to/from devices, such as, the accessory module 27, which can be configured to be electronically and/or physically coupled to the siderail communication system 37. It should be appreciated that the siderail communication system 37 can be configured to charge a battery (not shown) in the devices. It should also be appreciated that a light (not shown) can be used to indicate when the siderail communication system 37 is electrically coupled to and/or in communication with the device.

The siderail communication system 37 can include a communication interface 50 and a cable 51 as shown in FIG. 7. The cable 51 can couple the communication interface 50 to the control system 17 of the person-support apparatus 10. In one illustrative embodiment, the cable 51 can be routed through the siderail body 34, and along and/or through the linkage 36 to the control system 17. It should be appreciated that the control system 17 can include a power source (not shown). It should also be appreciated that the power source can be external to the person-support apparatus 10.

The communication interface 50 can be configured to transmit and/or receive a data signal and/or a power signal to/from the devices using wired and wireless techniques. In a wired configuration, the siderail communication interface 37 can be physically coupled to the device and/or system, such as, the accessory module 27. In one illustrative embodiment, the siderail communication interface 37 can be a plurality of contacts 50 configured to engage a corresponding plurality of contacts on the device and/or system. In one example, the contacts 50 can be positioned along at least a portion of the bottom of the grip 46 and/or the upper side surface 49 as shown in FIG. 7. In another illustrative embodiment, the siderail communication interface 37 can be a receptacle (not shown) configured to receive a corresponding connector (not shown) on the device. It should be appreciated that the device can include the receptacle configured to receive a corresponding connector.

In a wireless configuration, the siderail communication interface 37 can transmit and/or receive a data signal and/or a power signal without being physically connected to the device. In one illustrative embodiment, the communication interface 37 can include an inductive powering assembly IP1 with a first inductive coil IC1 positioned within the siderail body 34 and a second inductive coil IC2 positioned within the device, such as, the accessory module 27, that can configured to wirelessly transmit power from the siderail 26 to the device as shown in FIG. 9. It should be appreciated that the communication interface 37 can communicate power using other wireless techniques, such as, radio frequency (RF), infrared (IR), or other forms of wireless data transmission/reception and/or near field/far field wireless power transmission techniques. It should be appreciated that the inductive powering assembly IP1 can be located in the endboard EB1 or other locations on the person-support apparatus 10.

The accessory module 27 or a removable module 27 can be configured to be positionable within the grip opening 48 as shown in FIGS. 1-2. It should be appreciated that the accessory module 27 can be removably coupled to at least one endboard EB1. The accessory module 27 can be configured to transmit and/or receive a data signal and/or a power signal to/from an external device ED1 and/or the person-support apparatus 10. It should be appreciated that the accessory module 27 can transmit and/or receive a data signal and/or a power signal to/from a remote system (not shown) in communication with the accessory module 27, such as, a hospital network and/or a caregiver interface, such as, a nurse station, nurse call interface, remote device, an electronic medical device, or an electronic storage device. The external device ED1 can be at least one of a music and/or video player, such as, for example, an iPod, a mobile phone and/or smart phone, an electronic game device, an electronic personal organizer, or other personal electronic devices.

Figure 3:
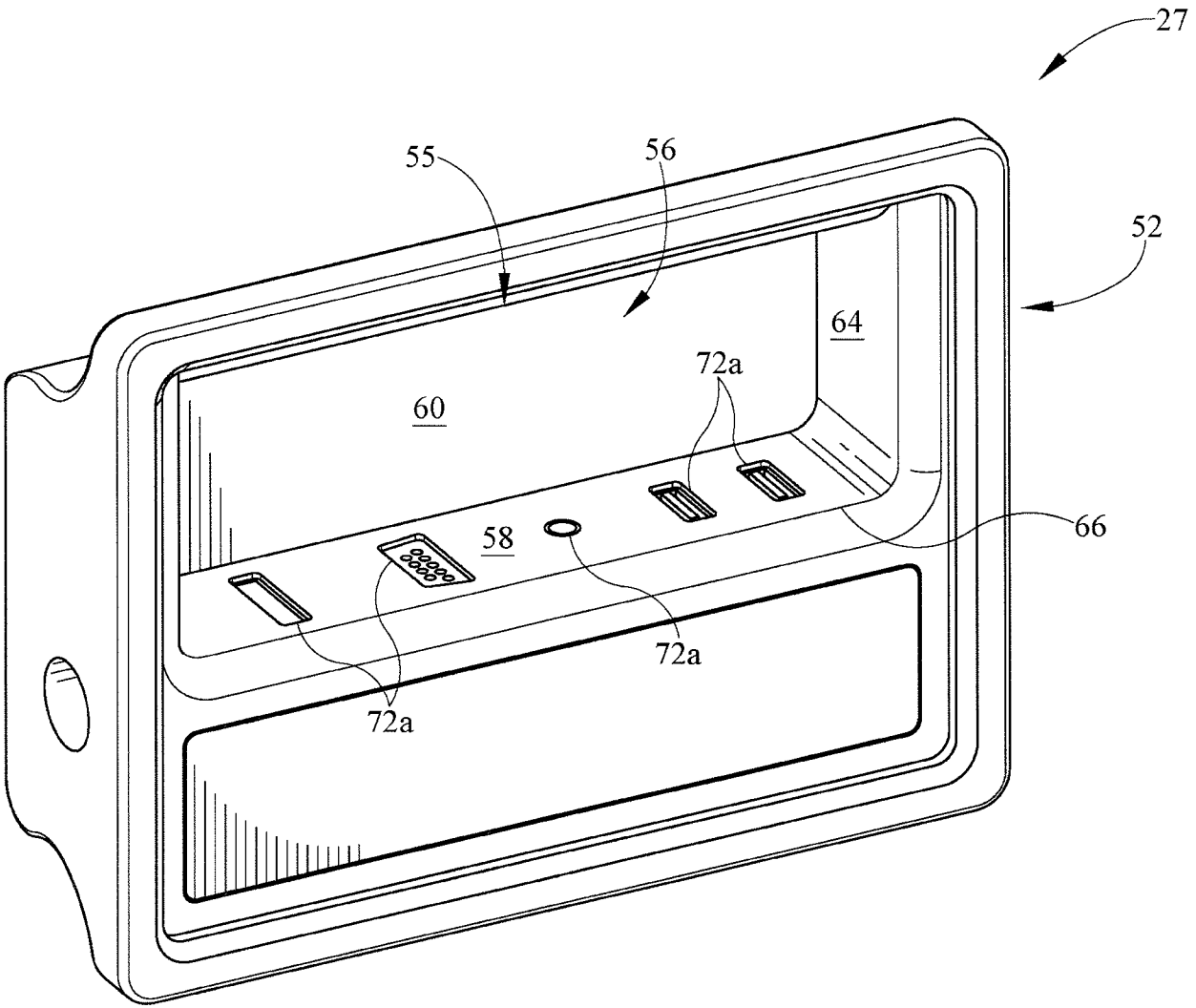
FIG. 3 is a perspective front view of the accessory module of FIG. 2 including a plurality of communication interfaces.
Figure 4:
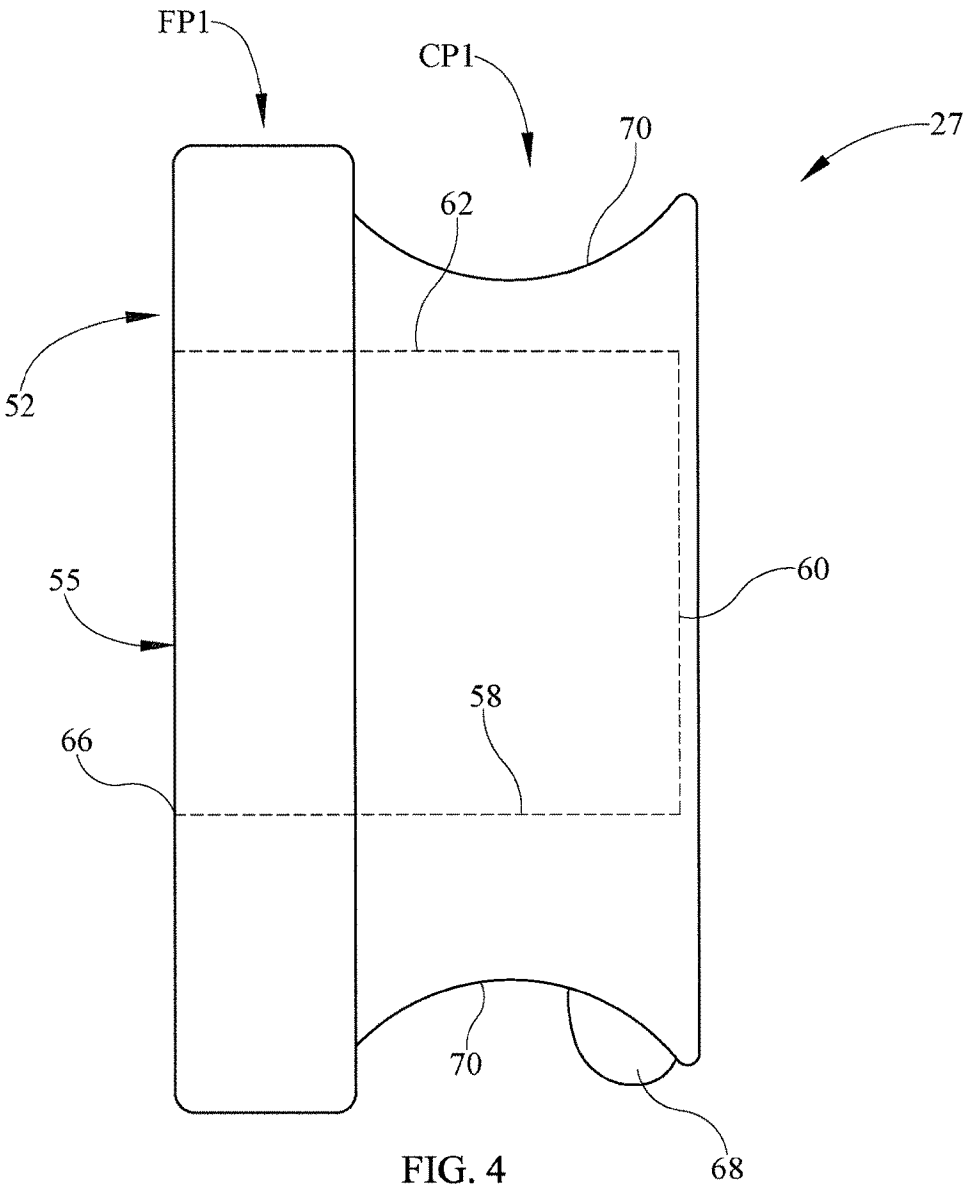
FIG. 4 is a side view of the accessory module of FIG. 2 showing a front portion and a coupling portion with a retainer and an engagement surface.
Figure 5:
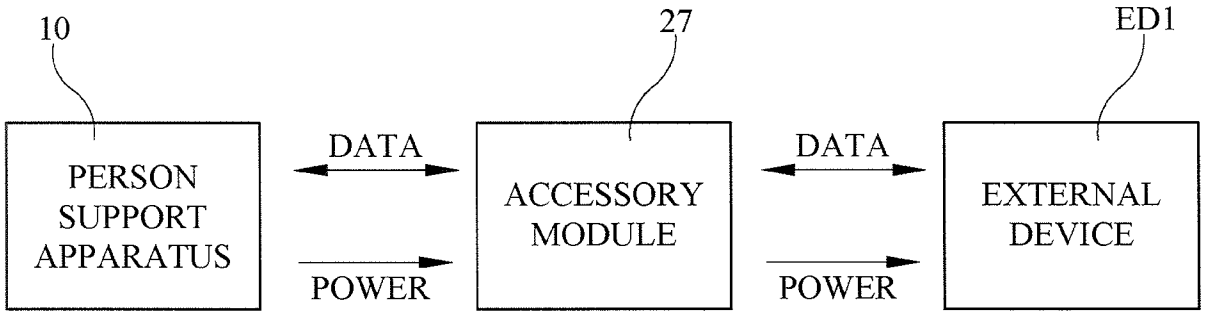
FIG. 5 is a diagrammatic view of the communication of data and/power signals between the person-support apparatus, accessory module, and external device according to one illustrative embodiment of the disclosure.
Figure 10:
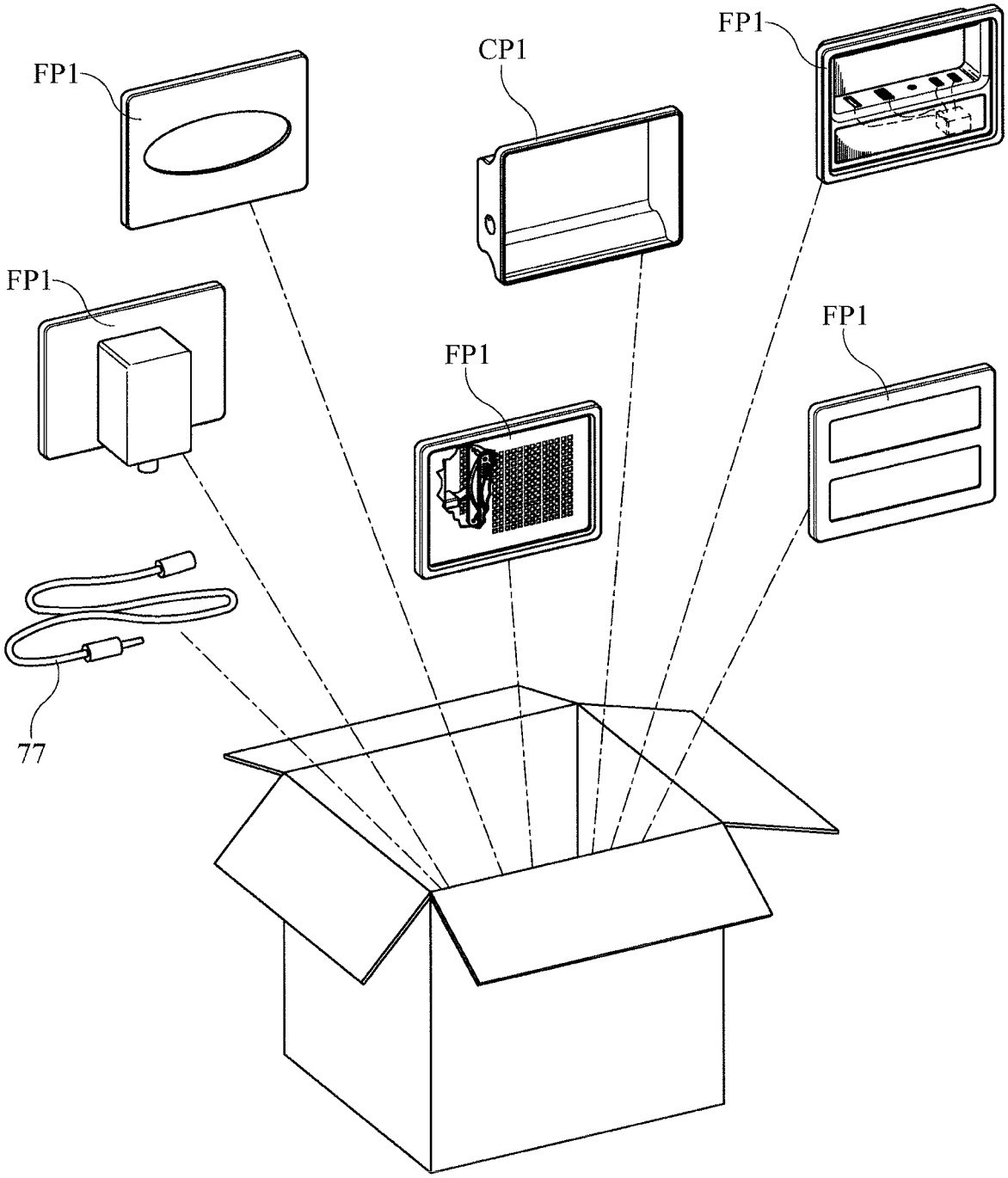
FIG. 10 is an exploded view of a kit including a plurality of different front portions configured to perform different functions, a coupling portion, and a cable according to one illustrative embodiment of the disclosure.

The accessory module 27 can include a housing 52 and a communication system 54 as shown in FIGS. 2-4 & 6-7. The housing 52 can be formed of a polymeric material and can be removably coupled to the person-support apparatus 10. The housing 52 can include a coupling portion CP1 and front portion FP1 as shown in FIG. 4. It should be appreciated that the housing 52 can also include a back portion (not shown) that can be removably coupled to the coupling portion such that the back portion cooperates with the front portion FP1 and the coupling portion CP1 to couple the accessory module 27 to the person-support apparatus 10. In one illustrative embodiment, the front portion FP1 can be removably couplable to the coupling portion CP1. It should be appreciated that the front portion FP1 can be part of a kit including multiple front portions FP1 configured to cooperate with the coupling portion CP1 to serve different purposes and/or perform different functions, such as, for example, storage, antimicrobial dispensing, tissue dispensing, cooling and/or heating, and/or other purposes and functions as shown in FIG. 10.

The housing 52 shown in FIGS. 2-4 & 6-7 can be configured to extend less than a predetermined distance beyond a plane extending along the first surface 38. It should be appreciated that the housing 52 can be configured to extend greater than or less than the predetermined distance when coupled to an endboard EB1 or other portion of the person-support apparatus 10. It should also be appreciated that the housing 52 can be configured to extend greater than the predetermined distance from the plane formed by the second surface 40. In one illustrative embodiment, the thickness of the siderail 26 with the accessory module 27 coupled thereto is less than about 3 inches. In another illustrative embodiment, the thickness of the coupling portion CP1 can be equal to about the thickness of the grip 46.

Figure 6:
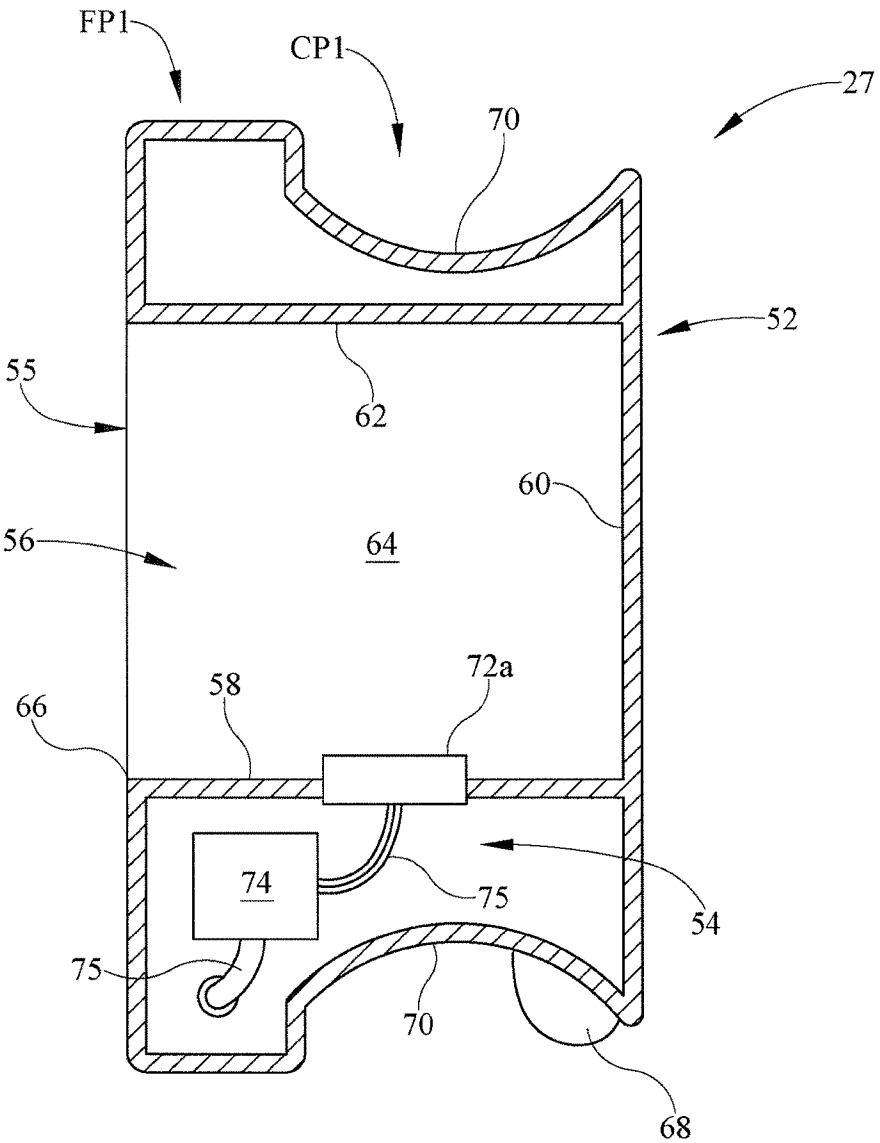
FIG. 6 is a side cross-sectional view of the accessory module according to one illustrative embodiment showing the communication system including a communication interface coupled to the bottom surface of the chamber and circuitry coupled to the communication interface via a cable.

The front portion FP1 of the housing 52 can include an opening 55 into a chamber 56 having a bottom surface 58, a rear surface 60, a top surface 62, and a plurality of side surfaces 64 shown in FIGS. 3-4 & 6. The side surface 64 can extend from about a front edge 66 of the bottom surface 58 to the rear surface 60, and from the bottom surface 58 to the top surface 62. The bottom surface 58 can be configured to support at least one external device ED1 thereon. It should be appreciated that the bottom surface 58 can be configured to removably retain the external device ED1 by way of a raised portion (not shown) along the front edge 66. It should also be appreciated that the external device ED1 can be retained on the bottom surface 58 with other fasteners or retainers (not shown). It should also be appreciated that the bottom surface 58 can be used for storage of both electronic devices and non-electronic devices.

The coupling portion CP1 can include a retainer 68 and engagement surfaces 70 as shown in FIGS. 4-7. In one illustrative embodiment, the retainer 68 can be a spring actuated mechanism that can be slidably or pivotably coupled to the housing 52 and movable relative to the housing 52 between extended and depressed or compressed positions. In another illustrative embodiment, the accessory module 27 can be configured to be press-fit or snapped into the grip opening 48. In still another embodiment, the retainer 68 can be a flexible tab (not shown) that can be deflected when inserting the housing 52 into the grip opening 48 and return to a substantially non-deflected state to provide a snap fit and couple the accessory module 27 within the grip opening 48. It should be appreciated that the accessory module 27 can be removed by pushing or pulling the accessory module 27 in the opposite direction from which it was press-fit or snapped in.

In yet another illustrative embodiment, the accessory module 27 can be configured to couple to at least one end board EB1. In still other embodiments, the accessory module 27 can be coupled to the siderails 26 and/or the end boards EB1 with hangers, hooks, clamps, fasteners (not shown), such as, screws, interlocking members, or other fastening elements. It should be appreciated that the accessory module 27 can be generally rectangular in shape. It should be further appreciated that the accessory module 27 can have antimicrobial properties.

The communication system 54 shown in FIGS. 6-7 can be configured to transmit and/or receive a data signal and/or a power signal to/from the external device ED1 and/or the person-support apparatus 10. The communication system 54 can include at a plurality of external device interfaces 72 and circuitry 74 positioned within the housing 51. It should be appreciated that the communication system 54 can include only one external device interface 72 configured to communicate with at least one external device ED1 and/or person-support apparatus 10. The communication system 54 can be configured to transmit and/or receive a data signal and/or a power signal to/from the external device ED1 and/or the person-support apparatus 10 through a wired connection and/or a wireless connection.

The circuitry 74 shown in FIGS. 6-7 can be electrically coupled to the external device interfaces 72*a* and 72*b* and can facilitate communication of data and/or power therebetween. In one illustrative embodiment, the circuitry 74 can include at least one cable 75 connecting the external device interfaces 72*a* and 72*b*. It should be appreciated that the cable 75 can connect the external device interface 72*a* directly to the data and/or power interface 25. In another illustrative embodiment, the circuitry 74 can include a controller (not shown) configured to control communication of data and/or power between the external device interfaces 72*a* and 72*b*, the external device ED1, and/or the person-support apparatus 10. In yet another illustrative embodiment, the circuitry 74 can be configured to regulate the voltage and/or current received from the person-support apparatus 10 such that the voltage and/or current transmitted to the external device ED1 is at a predetermined level, such as, for example, about 5 VDC. It should be appreciated that the predetermined level can be more or less than 5 VDC. In yet another illustrative embodiment, the circuitry 74 can include an analog to digital (A/D) and/or a digital to analog (D/A) converter. It should be appreciated that the circuitry 74 can include other digital and/or analog signal converters, shifters, encrypters and/or encoders, decrypters and/or decoders, or other digital and/or analog signal modifying hardware and/or software. In yet another illustrative embodiment, the circuitry 74 can include a power source (not shown), such as, for example, a battery, configured to supply power to the external device ED1 and/or various components of the accessory module 27. In still another illustrative embodiment, the circuitry 74 can include a wireless power transmitter and/or receiver (not shown) configured to transmit and/or receive power wirelessly to/from the external device and/or the person-support apparatus 10. It should be appreciated that the circuitry 74 can include an indicator light (not shown) configured to emit light when the accessory module 27 is transmitting and/or receiving a data signal and/or a power signal from at least one of the person-support apparatus 10 and external device ED1.

The external device interfaces 72 shown in FIGS. 3 & 6-7 can be a wired and/or wireless device configured to transmit and/or receive a data signal and/or a power signal to/from the external device ED1 and/or person-support apparatus 10. In a wired configuration, the external device interfaces 72 can be physically connected to the external device ED1 and/or the person-support apparatus 10. In one illustrative embodiment, the external device interfaces 72 can be a plurality of contacts 76 configured to engage corresponding contacts (not shown) on the external device ED1 and/or engage corresponding contacts 50 on the person-support apparatus 10, such as, the siderail communication interfaces 37 as shown in FIG. 7. It should be appreciated that individual contacts can be configured to communicate one or both of data and power. In one example, the electrical contacts 76 can be positioned along the engagement surfaces 70. In another example, the retainer 68 can include electrical contacts (not shown) that can engage corresponding electrical contacts 50 on at least one of the bottom of the grip 46 and the upper side surface 49 when the accessory module 27 is coupled to the siderail 26.

In another illustrative embodiment, the external device interfaces 72 can be a receptacle, such as, for example, a universal serial bus (USB) interface, located on the bottom surface 58 that can be configured to receive a first end of a cable 77, the second end of which can be configured to connect to the external device ED1 and/or the person-support apparatus 10 as shown in FIGS. 2-3 & 6-7. It should be appreciated that the cables 77 can be a group of cables supplied with the accessory module 27 in a kit with each cable 77 having a connector on the first end configured to couple to the external device interfaces 72, and at least one connector on the second end, which can be different than the connector on the first end, that can be configured to couple to different external devices ED1. It should also be appreciated that a kit can be provided including at least one cable 77, at least one front portion FP1, and/or a coupling portion CP1. It should also be appreciated that the external device interfaces 72 can be other sockets, plugs, and connectors, including, but not limited to, component video connectors, fiber optic connectors, cigarette lighter sockets, serial and/or parallel communication ports, or other electrical connections. It should also be appreciated that the external device interfaces 72 can be located on any surface of the housing 51. It should also be appreciated that the external device interfaces 72 can be configured to include separate power and data transmitting/receiving interfaces.

In a wireless configuration, the external device interfaces 72 shown in 3 & 6-7 can transmit and/or receive a data signal and/or a power signal to/from the external device ED1 and/or the person-support apparatus 10 regardless of whether the accessory module 27 is coupled to the person-support apparatus 10. In one illustrative embodiment, the external device interfaces 72 can be a Bluetooth wireless transceiver configured to transmit and/or receive data to/from the external device EDE the person-support apparatus 10, and/or a remote system (not shown). It should be appreciated that the data signal and/or the power signal can be transmitted and/or received using other wireless techniques, such as, radio frequency (RF), infrared (IR), inductive coupling, or other forms of wireless data transmission/reception and/or near field/far field wireless power transmission techniques. It should also be appreciated that the remote system can be a hospital network, nurse call system, and/or other remote systems. In another illustrative embodiment, the external device interfaces 72 can be an inductive arrangement configured to charge a power source (not shown) in the external device ED1 while the external device is positioned on the bottom surface 58.

Many other embodiments of the present disclosure are also envisioned. For example, a siderail assembly for a person support apparatus comprises a siderail body, a grip portion, and a power communication device. The siderail body includes a front surface, a back surface, and a side surface extending between the front surface and the back surface. The side surface defines a perimeter of the siderail body. The grip portion includes a siderail opening through a portion of the siderail body. The grip opening has an upper grip opening portion that cooperates with the side surface to define a grip. The power communication device is configured to communicate power wirelessly to a device in communication therewith.

In another illustrative embodiment, a siderail assembly for a person support apparatus comprises a siderail body, a grip portion, and a power communication device. The siderail body includes a perimeter edge and a grip portion. The grip portion includes a siderail opening through a portion of the siderail body. The grip opening has an upper grip opening portion that cooperates with the side surface to define a grip and a lower grip opening portion that cooperates with the siderail body to define a lower side surface. The power communication device is configured to communicate a power signal to a device in communication therewith. The power communication device is positioned along at least one of the lower side surface and the grip.

In yet another illustrative embodiment, a person-support apparatus comprises a lower frame, at least one support, an upper frame, a siderail, and a siderail accessory module. The at least one support is coupled to the lower frame. The upper frame is movably supported above the lower frame by the at least one support. The siderail includes a body with a perimeter edge and a grip portion, a power communication device, and a linkage. The linkage is configured to movably couple the body to the upper frame such that the body moves between a first position and a second position with respect to the upper frame. The siderail accessory module is configured to removably couple to the siderail. The power communication device is configured to communicate power to the siderail accessory module.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

The invention claimed is:

1. A person support apparatus comprising a frame, a patient support deck coupled to the frame and having at least one movable deck section, and a siderail coupled to the movable deck section, the siderail having a siderail body with at least one grip portion provided above a grip opening formed through the siderail body, the siderail having a patient device holder situated adjacent to the grip opening, the patient device holder having a surface configured to support at least a portion of a patient's mobile device thereon, the siderail including an electrical port that is configured to couple electrically with the patient's mobile device.

2. The person support apparatus of claim 1, wherein electricity for recharging the patient's mobile device is accessible via the electrical port.

3. The person support apparatus of claim 2, wherein the electrical port comprises a Universal Serial Bus (USB) port.

4. The person support apparatus of claim 1, wherein the patient device holder includes a cavity that is defined at least in part by the surface.

5. The person support apparatus of claim 4, wherein the patient device holder includes a raised portion to retain the patient's mobile device on the surface.

6. The person support apparatus of claim 1, wherein the siderail body has a head end and a foot end and wherein the patient device holder is situated closer to the head end than to the foot end.

7. The person support apparatus of claim 1, further comprising at least one link coupling the siderail to the movable deck section, the at least one link guiding movement of the siderail relative to the movable deck section between a raised position and a lowered position, and further comprising at least one wire that is routed to the electrical port along a first link of the at least one link.

8. The person support apparatus of claim 7, wherein the siderail body includes an interior space and the at least one wire is also routed through the interior space.

9. The person support apparatus of claim 8, wherein the patient device holder includes an inner space and the at least one wire is further routed though the inner space.

10. The person support apparatus of claim 1, further comprising at least one link coupling the siderail to the movable deck section, the at least one link guiding movement of the siderail relative to the movable deck section between a raised position and a lowered position, and further comprising at least one wire that is routed to the electrical port through a wire-receiving space formed in a first link of the at least one link.

11. The person support apparatus of claim 10, wherein the siderail body includes an interior space and the at least one wire is also routed through the interior space.

12. The person support apparatus of claim 11, wherein the patient device holder includes an inner space and the at least one wire is further routed though the inner space.

13. The person support apparatus of claim 1, wherein the siderail further includes an interface to selectably control at least one function of the person support apparatus.

14. The person support apparatus of claim 1, wherein the patient device holder has a first side surface and a second side surface, and wherein the electrical port is located between the side surfaces.

15. The person support apparatus of claim 1, wherein the electricity delivered to the patient's mobile device via the electrical port comprises 5 Volt direct current (VDC).

16. The person support apparatus of claim 1, wherein the patient device holder is detachable from the siderail body.

17. The patient support apparatus of claim 1, wherein the movable deck section comprises a head support section of the patient support deck.

18. The patient support apparatus of claim 1, wherein the siderail is movable relative to the patient support deck between a raised position and a lowered position and wherein the patient device holder is inaccessible to a patient supported by the patient support deck when the siderail is in the lowered position.

19. The patient support apparatus of claim 1, wherein the patient device holder is formed of a polymeric material.

20. The person support apparatus of claim 1, wherein the siderail body includes a top edge and a bottom edge and the patient device holder is located closer to the top edge than to the bottom edge.

* * * * *